US011104463B2

(12) United States Patent
Cybart et al.

(10) Patent No.: US 11,104,463 B2
(45) Date of Patent: Aug. 31, 2021

(54) ADJUSTABLE HORIZONTAL FORM-FILL-SEAL DEVICES AND METHODS OF USING SAME

(71) Applicant: NESTEC SA, Vevey (CH)

(72) Inventors: Mark Cybart, Dunkirk, NY (US); Casey Astry, Dunkirk, NY (US)

(73) Assignee: SOCIÉTÉ DES PRODUITS NESTLÉ S.A., Vevey (CH)

( * ) Notice: Subject to any disclaimer, the term of this patent is extended or adjusted under 35 U.S.C. 154(b) by 223 days.

(21) Appl. No.: 15/803,027

(22) Filed: Nov. 3, 2017

(65) Prior Publication Data

US 2018/0127132 A1 May 10, 2018

Related U.S. Application Data

(60) Provisional application No. 62/417,555, filed on Nov. 4, 2016.

(51) Int. Cl.
*B65B 51/07* (2006.01)
*B65B 65/00* (2006.01)
(Continued)

(52) U.S. Cl.
CPC ..... *B65B 51/07* (2013.01); *B65B 9/067* (2013.01); *B65B 9/073* (2013.01); *B65B 9/08* (2013.01);
(Continued)

(58) Field of Classification Search
CPC ..... B65B 61/188; B65B 9/08; B65B 9/093; B65B 51/14; B65B 51/146; B65B 51/26;
(Continued)

(56) References Cited

U.S. PATENT DOCUMENTS 3,706,177 A * 12/1972 Willett ..... B65B 59/003 53/76
6,153,864 A * 11/2000 Hammen ..... H05B 6/103 156/380.2
(Continued)

FOREIGN PATENT DOCUMENTS

EP 1099636 B1 5/2001

OTHER PUBLICATIONS

International search report, transmittal, and written opinion PCT/IB2017/056892 dated Feb. 7, 2018.

*Primary Examiner* — Anna K Kinsaul
*Assistant Examiner* — Veronica Martin

(57) ABSTRACT

A first film can be conveyed through a horizontal form-fill-seal machine that contains tooling stations in which bottom sealer bars are positioned in different tooling stations relative to side sealer bars. The first film can be processed by the machine to form a first pouch. After the first pouch is formed, a vertical height of one or more of the side sealer bars and/or one or more of the bottom sealer bars can be selectively adjusted. The same bottom and side sealer bars remain in the machine during the selective adjusting of the vertical height. After the selective adjusting of the vertical height of the component, a second film can be conveyed through the horizontal form-fill-seal machine. The second film can be processed by the machine to form a second pouch having at least one dimension that is different than the first pouch.

11 Claims, 5 Drawing Sheets

(51) Int. Cl.

| | |
|---|---|
| ***B65B 51/10*** | (2006.01) |
| ***B65B 9/093*** | (2012.01) |
| ***B65B 9/067*** | (2012.01) |
| ***B65B 9/073*** | (2012.01) |
| ***B65B 9/087*** | (2012.01) |
| ***B65B 59/00*** | (2006.01) |
| ***B65B 9/08*** | (2012.01) |
| ***B65B 51/04*** | (2006.01) |
| ***B65B 51/32*** | (2006.01) |
| ***B65B 61/18*** | (2006.01) |
| ***B65B 9/06*** | (2012.01) |

(52) U.S. Cl.
CPC ..... *B65B 9/087* (2013.01); *B65B 9/093* (2013.01); *B65B 51/046* (2013.01); *B65B 51/10* (2013.01); *B65B 51/32* (2013.01); *B65B 59/003* (2019.05); *B65B 61/188* (2013.01); *B65B 65/00* (2013.01); *B65B 65/003* (2013.01); *B65B 2009/063* (2013.01); *B65B 2220/08* (2013.01)

(58) Field of Classification Search
CPC .. B65B 1/07; B65B 1/046; B65B 1/10; B65B 1/32; B65B 1/188; B65B 9/003; B65B 9/067; B65B 9/073; B65B 9/087; B65B 65/00; B65B 65/003; B65B 2009/063; B65B 2220/08
USPC ..... 53/455, 562, 412, 133.4, 139.2
See application file for complete search history.

(56) References Cited

U.S. PATENT DOCUMENTS

| | | | | |
|---|---|---|---|---|
| 6,234,777 | B1 | 5/2001 | Sperry | |
| 2003/0145559 | A1* | 8/2003 | Buchman | B65B 61/188 53/412 |
| 2008/0253701 | A1* | 10/2008 | Wilson | B65B 9/213 383/207 |

* cited by examiner

--PRIOR ART--

ADJUSTABLE HORIZONTAL FORM-FILL-SEAL DEVICES AND METHODS OF USING SAME

CROSS REFERENCE TO RELATED APPLICATIONS

This application is a non-provisional application based on U.S. Provisional Patent Application 62/417,555, filed Nov. 4, 2016, the contents of which are incorporated herein by reference in its entirety.

FIELD OF THE INVENTION

The present disclosure relates generally to devices and methods for packaging. More specifically, the present disclosure is directed to horizontal form-fill-seal devices in which one or more sealer bars have an adjustable position therein.

BACKGROUND

Form-fill-seal machines are used in the packaging industry and are generally made of numerous components that perform separate steps of forming a container, filling the container with a product such as a food or medical product, and sealing the container. Typically, the machine processes a roll of film into flexible containers such as pouches.

In a horizontal form-fill-seal (HFFS) machine, a heat sealable film is moved horizontally through stations of the machine. First the film is folded (e.g., by a forming plow). Then at subsequent stations, vertical seals are imparted by vertical sealer bars to form the side seals of the container and a horizontal seal is imparted by a horizontal sealer bar at the bottom of the container to form the bottom seal of the container. The machine moves the container to a filler station that dispenses the product into the container, and then a downstream horizontal sealer bar imparts a horizontal seal at the top of the container to seal the product in the container.

Known horizontal form-fill-seal machines are capable of making pouches with different widths, lengths, and gussets. Each pouch has its own set of side/bottom sealers designed for the specific dimensions of the pouch. When the packing line is being changed over for a pouch of a different size, the four combinations of side/bottom sealers need to be removed from the machine, and the appropriate sets of side/bottom sealers are brought to the machine from their storage location and installed for the new pouch. The sealer bars that are removed from the machine then need to be transported to their storage location. The new sealer bars that are installed will then need time to heat to their selected temperatures, typically about 370 degrees Fahrenheit.

SUMMARY

In a general embodiment, the present disclosure provides a method of producing a first pouch and a second pouch having at least one dimension that is different than the first pouch. The method comprises: conveying a first film through a horizontal form-fill-seal (HFFS) machine that comprises tooling stations in which bottom sealer bars are positioned in different tooling stations relative to side sealer bars, and processing of the first film by the HFFS machine forms the first pouch; after the first pouch is formed, selectively adjusting a vertical height of a component selected from the group consisting of one or more of the side sealer bars, one or more of the bottom sealer bars, and a combination thereof, wherein the same bottom and side sealer bars remain in the HFFS machine during the selective adjusting of the vertical height of the component; and after the selective adjusting of the vertical height of the component, conveying a second film through the horizontal form-fill-seal machine, and processing of the second film by the HFFS machine forms the second pouch.

In another embodiment, the present disclosure provides a horizontal form-fill-seal (HFFS) machine comprising a lower frame and a plurality of sealer bars comprising a first side sealer bar, a second side sealer bar, a third side sealer bar, a fourth side sealer bar, a first bottom sealer bar and a second bottom sealer bar. A first station can include the first side sealer bar and the second side sealer bar; a second station downstream from the first station can include the third side sealer bar and the fourth side sealer bar; and a third station downstream from the second station can include the first bottom sealer bar and the second bottom sealer bar. Each of the first, second and third stations can include posts extending from the lower frame, and each of the posts can have a corresponding one of the sealer bars mounted thereon.

In an embodiment, the HFFS machine can include a fastener that mounts the third side sealer bar and/or the fourth side sealer bar on the corresponding post in the second station. The fastener reversibly and selectively moves between a first configuration in which a position of the side sealer bar on the corresponding post is maintained and a second configuration is which the side sealer bar is movable to adjust a vertical height of the side sealer bar relative to the lower frame.

Additionally or alternatively, the HFFS machine can include fasteners that mount the bottom sealer bars on the corresponding post in the third and fourth stations. The fastener reversibly and selectively moves between a first configuration in which a position of the bottom sealer bar on the corresponding post is maintained and a second configuration is which the bottom sealer bar is movable to adjust a vertical height of the bottom sealer bar relative to the lower frame.

An advantage of one or more non-limiting embodiments provided by the present disclosure is a form-fill-seal machine that uses sealer bars to make packages, such as pouches, of different widths and lengths without the need to replace the sealer bars with different sealer bars.

Another advantage of one or more non-limiting embodiments provided by the present disclosure is a form-fill-seal machine in which adjustable sealer bars achieve savings in down time and energy expenditure and reduce the storage space needed and tooling prices.

A further advantage of one or more non-limiting embodiments provided by the present disclosure is to separate side sealer and bottom sealer bars, allowing them to be individually adjusted and stay on the packing line, contrary to prior art sealer bar posts which must be substituted and heated for every different pouch size created.

Yet another advantage of one or more non-limiting embodiments provided by the present disclosure is extended side sealer bars fabricated to allow full range adjustability of the sealer bars without tools to accommodate every pouch size that the other components of the machine are capable of producing.

Furthermore, an advantage of one or more non-limiting embodiments provided by the present disclosure is a gusset hole press and an apex press combined into one single device for which (i) the height of the combined press can cover both the gusset and the apex regardless of the plow size and (ii) only one adjustment step is necessary, both features aiding simplicity and efficiency.

Still further, an advantage of one or more non-limiting embodiments provided by the present disclosure is a gusset hole press and an apex press combined into one single device to thereby create space on one of the tool posts, e.g., space that can be used by a bottom sealer separated from the side sealer with which it traditionally is associated in prior art machines.

Moreover, an advantage of one or more non-limiting embodiments provided by the present disclosure is a tear notch tool post shortened to allow for vertical clearance with an inline tear notch knife.

Another advantage of one or more non-limiting embodiments provided by the present disclosure is allowing one of the tool posts to accommodate another tool due to eliminating the offset tear notch.

A further advantage of one or more non-limiting embodiments provided by the present disclosure is narrowed bottom seal cooler bars that create more space for added tool post configurations and a label (e.g., instant redeemable coupon) applicator.

Yet another advantage of one or more non-limiting embodiments provided by the present disclosure is full length side seal bars on the non-operator side of machine which do not require vertical adjustment.

Furthermore, an advantage of one or more non-limiting embodiments provided by the present disclosure is full length side seal cooler bars on both sides of the machine which do not require vertical adjustment.

Still further, an advantage of one or more non-limiting embodiments provided by the present disclosure is press pads on the non-operator side of the machine which do not require vertical adjustment.

Additional features and advantages are described herein and will be apparent from the following Detailed Description and the Figures.

DETAILED DESCRIPTION

Definitions

Figure 1:
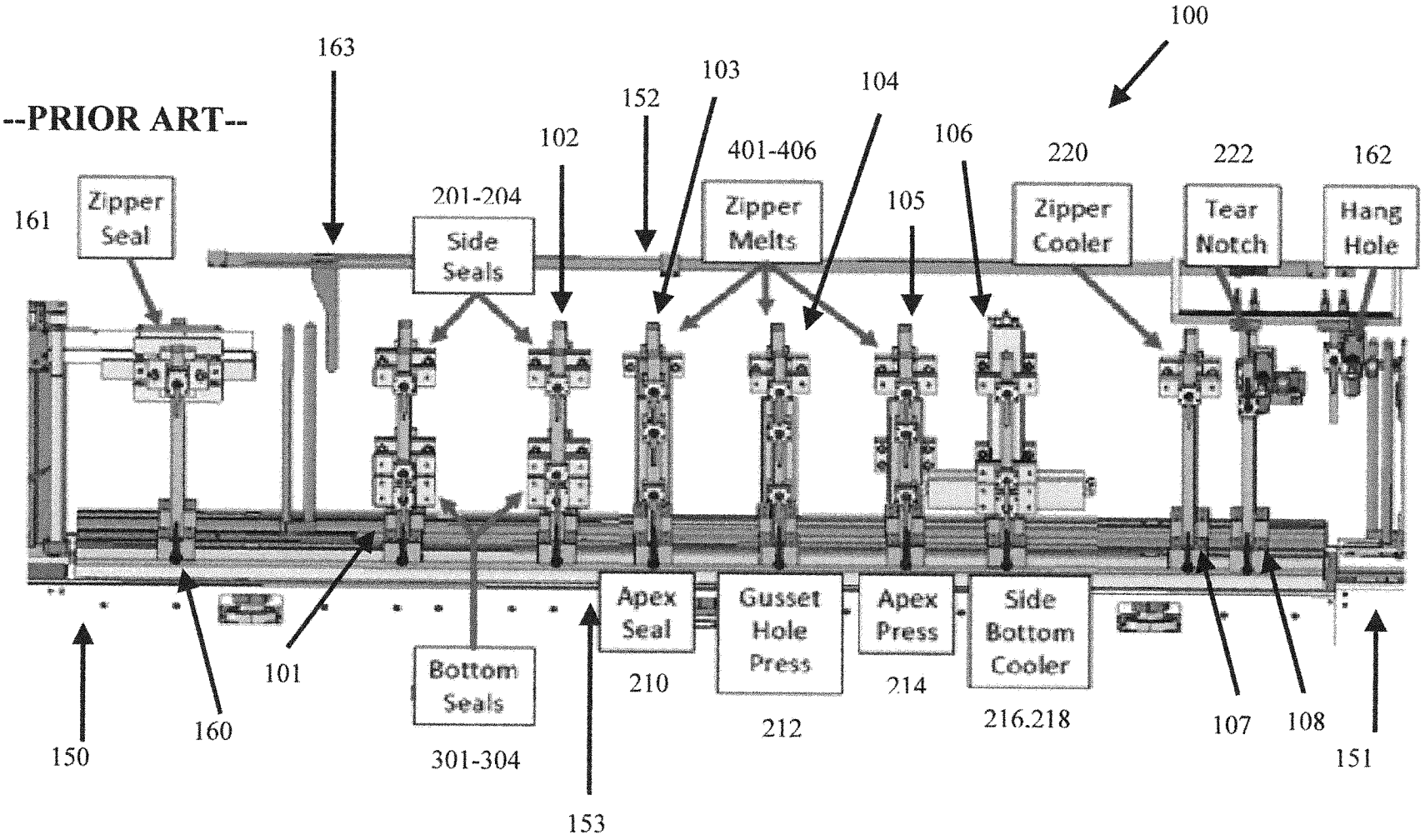
FIG. 1 shows a schematic diagram of a prior art horizontal form-fill-seal (HFFS) machine.

Some definitions are provided hereafter. Nevertheless, definitions may be located in the "Embodiments" section below, and the above header "Definitions" does not mean that such disclosures in the "Embodiments" section are not definitions.

As used in this disclosure and the appended claims, the singular forms "a," "an" and "the" include plural referents unless the context clearly dictates otherwise. Thus, for example, reference to "a pouch" or "the pouch" includes two or more pouches.

The words "comprise," "comprises" and "comprising" are to be interpreted inclusively rather than exclusively. Likewise, the terms "include," "including" and "or" should all be construed to be inclusive, unless such a construction is clearly prohibited from the context.

Nevertheless, the devices and apparatuses disclosed herein may lack any element that is not specifically disclosed. Thus, a disclosure of an embodiment using the term "comprising" includes a disclosure of embodiments "consisting essentially of" and "consisting of" the components identified. Similarly, the methods disclosed herein may lack any step that is not specifically disclosed herein. Thus, a disclosure of an embodiment using the term "comprising" includes a disclosure of embodiments "consisting essentially of" and "consisting of" the steps identified.

The term "and/or" used in the context of "X and/or Y" should be interpreted as "X," or "Y," or "X and Y." Where used herein, the terms "example" and "such as," particularly when followed by a listing of terms, are merely exemplary and illustrative and should not be deemed to be exclusive or comprehensive. Any embodiment disclosed herein can be combined with any other embodiment disclosed herein unless explicitly stated otherwise.

As used herein, "about" and "approximately" are understood to refer to numbers in a range of numerals, for example the range of −10% to +10% of the referenced number, preferably within −5% to +5% of the referenced number, more preferably within −1% to +1% of the referenced number, most preferably within −0.1% to +0.1% of the referenced number.

The term "manually" means by a human operator, and the term "automatically" means by a control signal from a controller or processor without substantially concurrent user input being necessary. An operation performed "automatically" can comprise one or more actions by the corresponding device, but each of the actions is performed without a requirement of user input.

As used herein, "reversibly" movable means that the referenced component can be moved between the identified positions without damaging any of the referenced components and without damaging a connector, if any. Correspondingly, a "fixed" position means the component has one or more mechanical connections that would need to be broken or otherwise damaged in order to move the component out of the position. "Selectively moving," "selectively adjusting" and the like mean that the referenced component is moved to a desired position by a human or by a control signal from a controller or processer. For example, "selectively moving," "selectively adjusting" and the like do not encompass unintentional movement of the component, such as vibrations during operation.

As used herein, "at the top" does not mean that the component is completely flush with the top end of the referenced structure and instead merely means that the component is closer to the top end of the referenced structure than the bottom end of the referenced structure. Similarly, "at the bottom" does not mean that the component is completely flush with the bottom end of the referenced structure and instead merely means that the component is closer to the bottom end of the referenced structure than the top end of the referenced structure.

Embodiments

An aspect of the present disclosure is a horizontal form-fill-seal (HFFS) machine 100. FIG. 1 is a schematic diagram on the traditional configuration of a known HFFS machine (e.g., a Roberts C-1500™). Specifically, the machine 100 comprises an upstream end 150 and a downstream end 151 and capable of making pouches with different widths, lengths, and gussets. The HFFS machine 100 can comprise a mechanism that conveys one or more continuous flat rolls of film (e.g., thermoplastic material such a polypropylene, polyester and/or polyethylene) and optionally a roll of zipper material through the machine 100 from the upstream end 150 to the downstream end 151. The mechanism can move the one or more films and optionally the zipper material through the machine 100 continuously or intermittently. Non-limiting examples of suitable conveying mechanisms include rollers and/or another mechanism such as a gripper chain extending the entire length of the machine 100 that mechanically grips the edges of the one or more films and moves them downstream.

The conveying mechanism can comprise an upper member that is reversibly movable on the upper frame 152 of the machine 100 and grips the top end of the one or more films and can comprise a lower member that is reversibly movable on the lower frame 153 of the machine 100 and grips the bottom end of the one or more films. Movement of the upper and lower members is synchronized, preferably by a controller or processor. Preferably the upper and lower frames 152, 153 each extend from the upstream end 150 to the downstream end 151.

All references herein to "upstream," "downstream," "downward," "upward," "vertical," "horizontal" and the like are relative to the positioning of the machine 100 as shown in FIG. 1 which depicts the upstream end 150, the downstream end 151, the upper frame 152 and the lower frame 153. For example, "upward" means away from the lower frame 153 and toward the upper frame 152.

The one or more films can be conveyed to a first station 101 comprising a first post 171 and a second post 172 opposite each other, then a second station 102 downstream from the first station 101 and comprising a third post 173 and a fourth post 174 opposite each other, then a third station 103 downstream from the second station 102 and comprising a fifth post 175 and a sixth post 176 opposite each other, and then a fourth station 104 downstream from the third station 103 and comprising a seventh post 177 and an eighth post 178 opposite each other Preferably each of the posts 171-178 extends upward from the lower frame 153 of the machine 100 and is reversibly movable relative to the lower frame 153. For example, one or more of the posts 101-104 can slide toward the upstream end 150 or toward the downstream end 151 and then be fixed in position, e.g., using a bolt or other fastener. In a non-limiting embodiment, one or more of the posts 171-178 can use a dovetail mount for reversibly being movable and fixed in position.

In an embodiment, the machine 100 comprises one or more of a fifth station 105 comprising a ninth post 179 and a tenth post 180 opposite each other, a sixth station 106 comprising an eleventh post 181 and a twelfth post 182 opposite each other, a seventh station 107 comprising a thirteenth post 183 and a fourteenth post 184 opposite each other, or an eighth station 108 comprising a fifteenth post 185 and a sixteenth post 186 opposite each other. The stations 101-108 can sequentially process the one or more films, as discussed in more detail hereafter.

The machine 100 can comprise a first side sealer bar 201 and a second side sealer bar 202 that can form a first clamp. Additionally, a first bottom sealer bar 301 and a second bottom sealer bar 302 can form a second clamp. A third side sealer bar 203 and a fourth side sealer bar 204 can form a third clamp. Additionally, a third bottom sealer bar 303 and a fourth bottom sealer bar 304 can form a fourth clamp. The sealer bar of each clamp can be vertically and/or horizontally aligned at the same height as the opposite sealer bar, and one or both of the sealer bars of each claim can be reversibly moved into and out of contact with the opposite sealer bar. Each of the sealer bars 201-204, 301-304 comprises a heating element and a sealing surface configured to seal one film to the opposite film when clamped between the corresponding sealer bars.

Known HFFS machines mount the first side sealer bar 201 and the first bottom sealer bar 301 on one of the posts of the first station 101 (i.e., one of the first post 171 or the second post 172), and the second side sealer bar 202 and the second bottom sealer bar 302 are mounted on the other post of the first station 101 (i.e., the other one of the first post 171 or the second post 172). The third side sealer bar 203 and the third bottom sealer bar 303 are mounted on one of the posts of the second station 102 (i.e., one of the third post 173 or the fourth post 174), and the fourth side sealer bar 204 and the fourth bottom sealer bar 304 are mounted on the other post of the second station 102 (i.e., the other one of the third post 173 or the fourth post 174).

Figure 2:
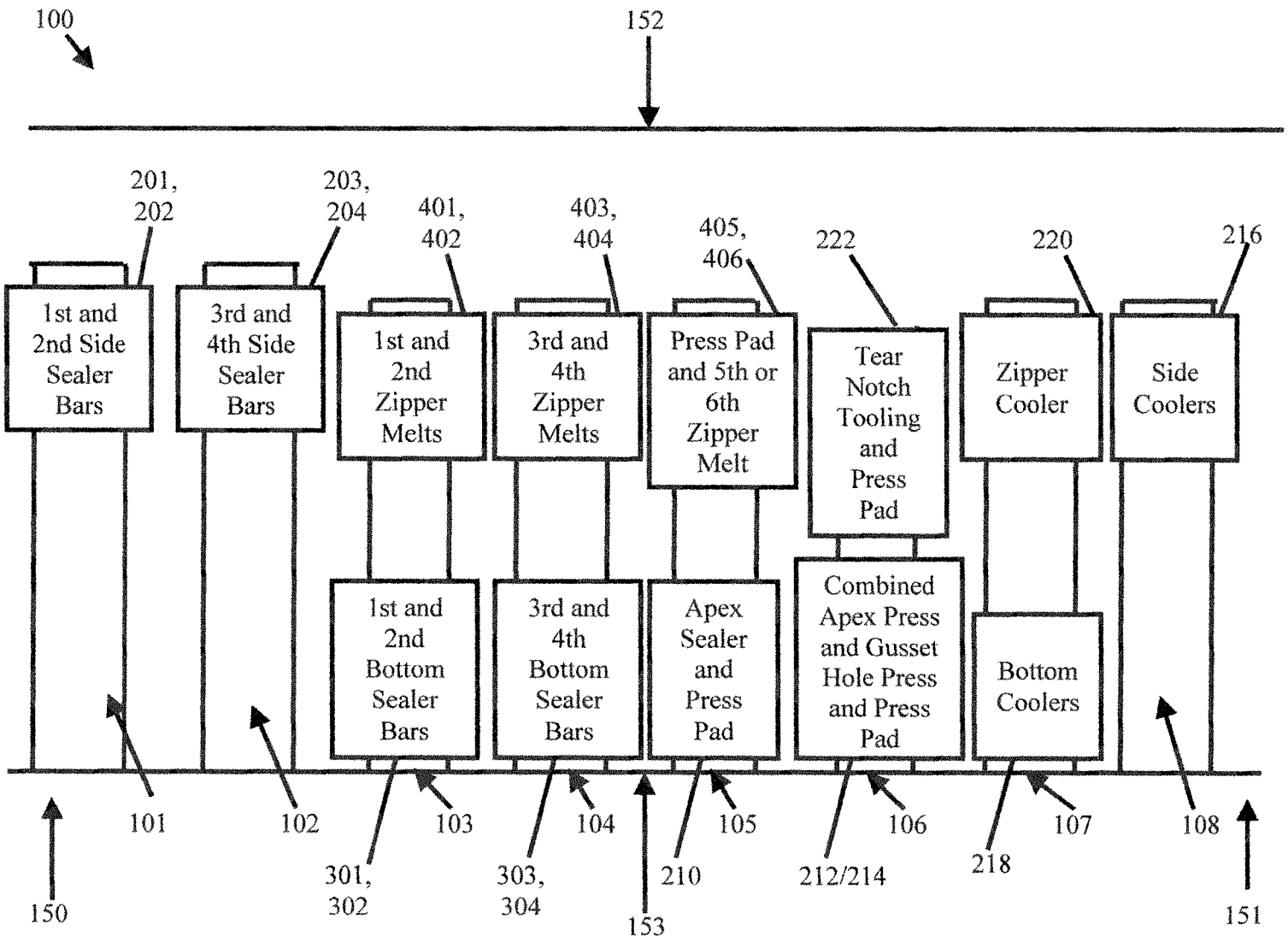
FIG. 2 shows a schematic diagram of a section of an embodiment of an HFFS machine provided by the present disclosure.

As shown in FIG. 2, an aspect of the present disclosure is a structure of the machine 100 that modifies this known configuration and surprisingly achieves savings in down time and energy expenditure and reduces the storage space needed and tooling prices. In this regard, the first and second bottom sealer bars 301, 302 can be attached in a station other than the first station 101 and thus in a different station than the first and second side sealer bars 201, 202. In a preferred embodiment, the first and second bottom sealer bars 301, 302 can be positioned downstream from the side sealer bars 201-204, most preferably at the bottom of the third station 103.

Figure 3:
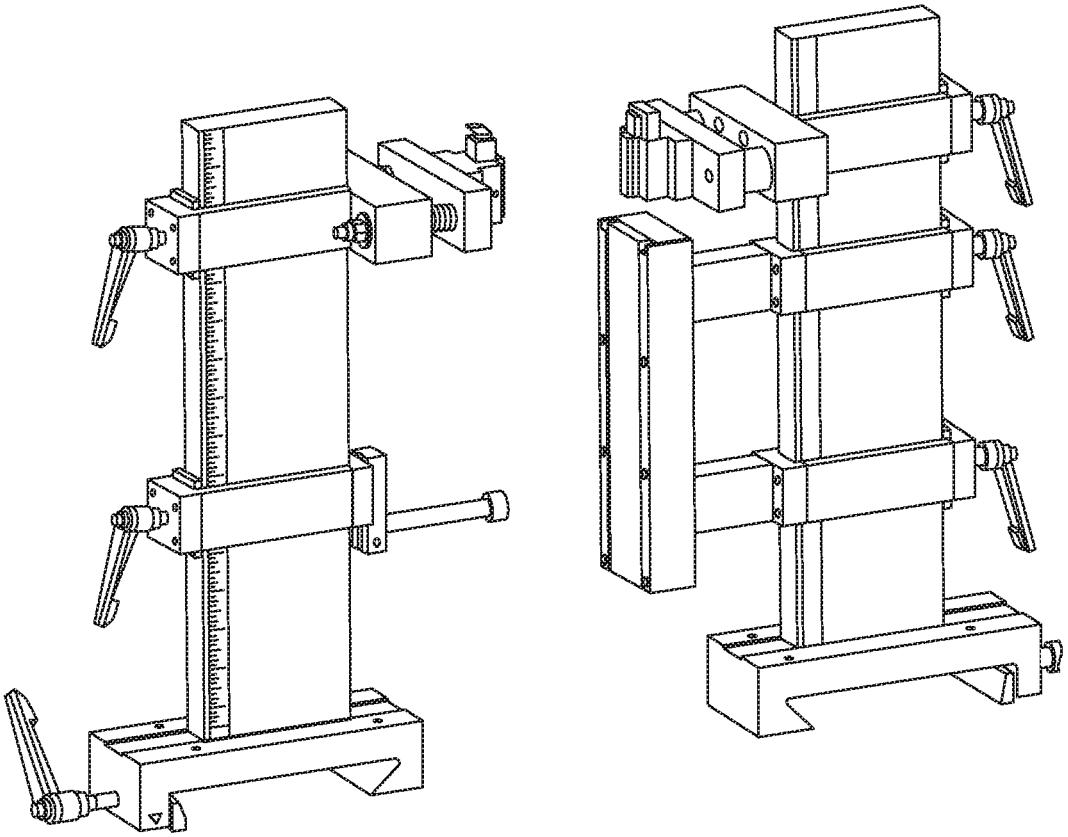
FIG. 3 shows a tooling station in an embodiment of an HFFS machine provided by the present disclosure.
Figure 4:
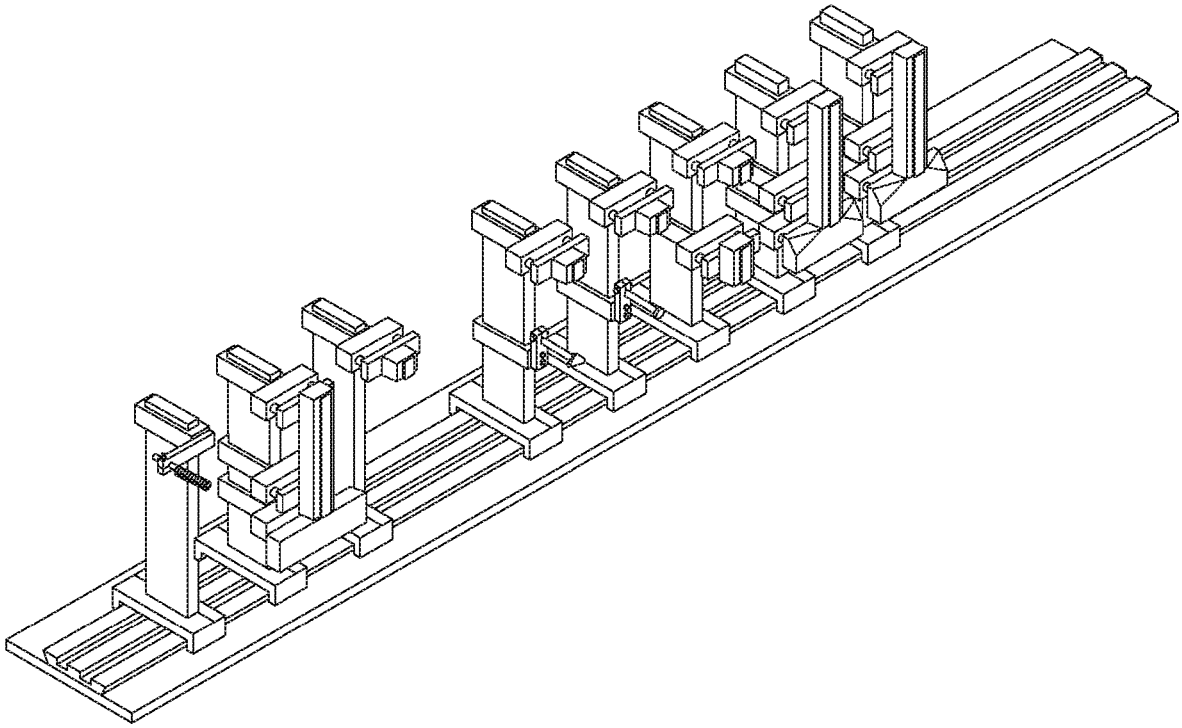
FIG. 4 shows a schematic diagram of a horizontal form-fill-seal (HFFS) machine.
Figure 5:
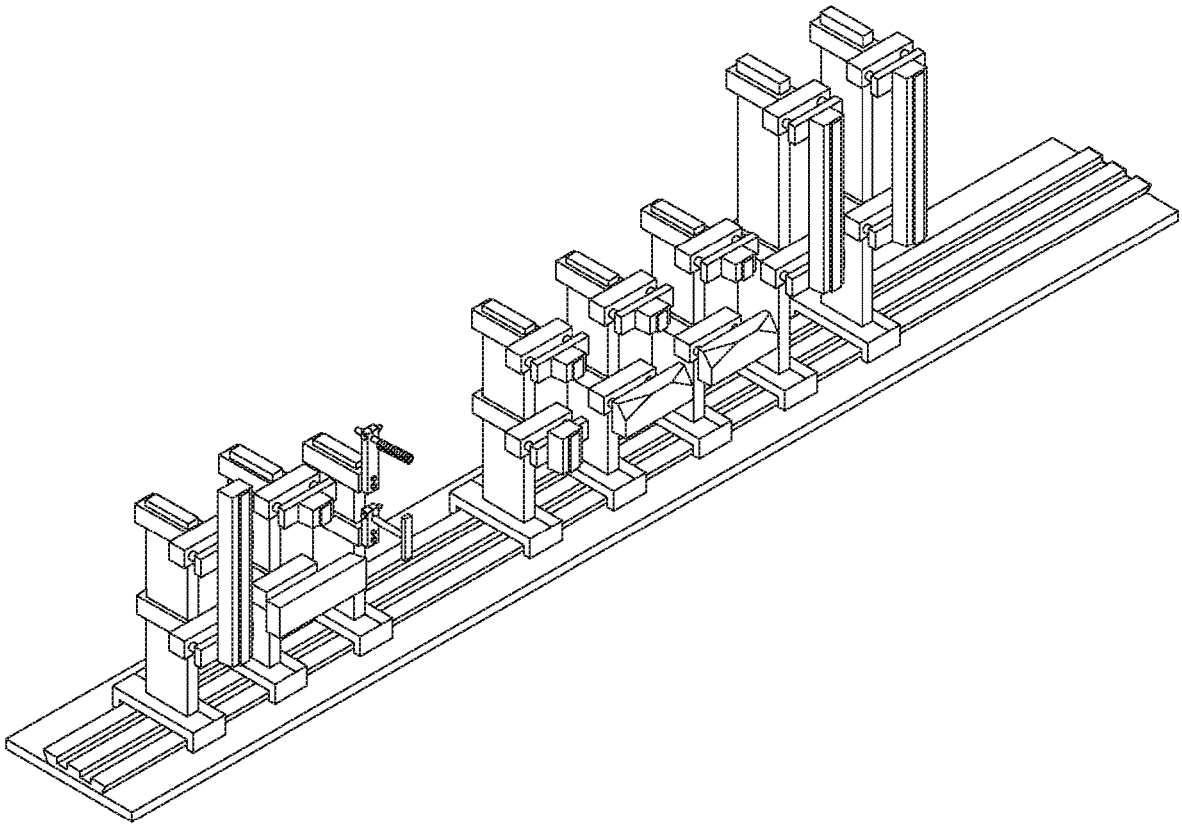
FIG. 5 shows a tooling station in an embodiment of an HFFS machine provided by the present disclosure.

FIG. 3 generally illustrates a non-limiting example of a tooling station that can be employed in the machine 100 according to the present disclosure. In this non-limiting example, sealer bars are adjustably positioned at the top of the tooling station on opposite posts, and a press pad is positioned at the bottom of the tooling station opposite from a corresponding processing device. This non-limiting example or a variation thereof (e.g., sealer bars at the bottom of the station) can be used in each of one or more of the tooling stations disclosed herein.

Referring again to FIG. 2, the third and fourth bottom sealer bars 303, 304 are preferably attached in a station other than the second station 102 and thus in a different station than the third and fourth side sealer bars 203, 204. In a particularly preferred embodiment, the third and fourth bottom sealer bars 303, 304 can be positioned downstream from the side sealer bars 201-204, most preferably at the bottom of the fourth station 104. In this regard, side sealer bars can be positioned in one station, and bottom sealer bars can be separated from the side sealer bars and positioned in another station downstream from the side sealer bars in an embodiment of the machine 100.

According to the present disclosure, the first and second side sealer bars 201, 202 preferably have a machined relief in the sealing surface where a zipper can contact the first and second side sealer bars 201, 202. Preferably, the first and second side sealer bars 101, 102 are fixed in position at the top of the first and second posts 171, 172 respectively and cannot be adjusted up or down in the first station 101.

The third and fourth side sealer bars 203, 204 each preferably comprise a sealing surface that is continuous thereon. Preferably, each of the third and fourth side sealer bars 203, 204 are reversibly adjustable up and down on the third and fourth posts 173, 174 respectively, e.g., for a pouch length changeover. For example, after the film for the new pouch has been run through the machine 100, the bottom of the third and fourth side sealer bars 203, 204 can be adjusted to the top of the pouch gusset or just above the top of the pouch gusset, for example such that there is approximately 1.125 inches of film above the zipper.

In a preferred embodiment, one or more of the posts of the first and second stations 101, 102 (i.e., one or more of the first, second, third and fourth posts 171-174) are taller than the posts of the third and fourth stations 103, 104 (i.e., one or more of the fifth, sixth, seventh and eighth posts 175-178). Such a configuration can allow the one or more corresponding side sealer bars (i.e., one or more of the first, second, third and fourth sealer bars 201-204 to be adjusted as need to produce long pouches or produce short pouches. In an embodiment, one or more of the side sealer bars 201-204 have an extended length that allows full range adjustability of the side sealer bars 201-204 without tools to accommodate every pouch size that the other components of the machine 100 are capable of producing.

Preferably the bottom sealer bars 301-304 have identical structures. Preferably, each of the bottom sealer bars 301-304 are reversibly adjustable up and down on the corresponding post, e.g., for a pouch length changeover. When there is a pouch length change, the top of the bottom sealer bars 301-304 can be adjusted to the top of the gusset after the film is ran through the machine 100.

Turning back to known HFFS machines (FIG. 1), an apex sealer 210 is positioned in the third station 103 (i.e., mounted on the bottom of one of the fifth and sixth posts 175, 176), and first and second zipper melts 401, 402 are positioned in the third station 103 (i.e., mounted on the top of one or both of the fifth and sixth posts 175, 176). A gusset hole press 212 is positioned in the fourth station 104 (i.e., mounted on the bottom of one of the seventh and eighth posts 177, 178) in known HFFS machines. An apex press 214 is positioned in the fifth station 105 (i.e., mounted on the bottom of one of the seventh and eighth posts 177, 178) in known HFFS machines. As a result, the gusset hole press 212 and the apex press 214 take up space in two different stations in known HFFS machines.

In known HFFS machines, third and fourth zipper melts 403,404 are positioned in the fourth station 104 (i.e., mounted on the top of one or both of the seventh and eighth posts 177, 178), and fifth and sixth zipper melts 405, 406 are positioned in the fifth station 105 (i.e., mounted on the top of one or both of the ninth and tenth posts 179, 180). In known HFFS machines, side seal cooler bars 216 and bottom seal cooler bars 218 are combined together and are positioned in the sixth station 106 (i.e., mounted on one or both of the eleventh and twelfth posts 181, 182). In known HFFS machines, a zipper cooler 220 is positioned in the seventh station 107 (i.e., mounted on one or both of the thirteenth and fourteenth posts 183, 184); and tear notch tooling 222 (i.e., a knife or other cutting device that scores the pouch) is attached in the eighth station 108 (i.e., mounted on one or both of the fifteenth and sixteenth posts 185, 186).

According to the present disclosure (FIG. 2), the structure of the machine 100 can modify this known configuration to provide space for the first and second bottom sealer bars 301, 302 that are preferably mounted in the third station 103 and/or for the third and fourth bottom sealer bars 303, 304 that are preferably mounted in the fourth station 104. For example, as shown in FIG. 2, the apex sealer 210 (and a corresponding press pad) can be mounted in the fifth station 105 instead of the third station 103; the gusset hole press 212 (and a corresponding press pad)can be mounted in the sixth station 106 instead of the fourth station 104; the apex press 214 can be mounted in the sixth station 106 instead of the fifth station 105; the bottom seal cooler bars 218 can be mounted in the seventh station 107 instead of the sixth station 106; the tear notch tooling 222 can be mounted in the sixth station 106 instead of the eighth station 108; and the side seal cooler bars 216 can be mounted in the eighth station 108 instead of the sixth station 106.

The zipper melts 401-406 are preferably fixedly positioned in the third, fourth and fifth stations 103-105 such that they cannot be moved up or down. As noted above, an embodiment of the present disclosure mounts the apex sealer 210 (and a corresponding press pad) in the fifth station 105 instead of the third station 103. The apex sealer 210 preferably can reversibly move up and down on the corresponding post in the fifth station 105. A post of the fifth station 105 can comprise the fifth zipper melt 405 or the sixth zipper melt 406 at the top of the post and the apex sealer 210 at the bottom of the post. An upper press pad can be mounted on the other post opposite the zipper melt bar of the fifth zipper melt 405 or the sixth zipper melt 406, and/or a lower press pad can be mounted on the same post, opposite the apex sealer 210. These press pads are preferably fixedly connected to the corresponding post such that they cannot be moved up or down.

As noted above, an embodiment of the present disclosure mounts the gusset hole press 212 in the sixth station 106 instead of the fourth station 104 and/or mounts the apex press 214 in the sixth station 106 instead of the fifth station 105. In a preferred embodiment, the gusset hole press 212 and the apex press 214 are combined into a unitary device, e.g., a one piece press that contacts the gusset holes and the gusset apex at the same time. In such an embodiment, the unitary gusset hole press 212/apex press 214 (and a corresponding press pad) preferably is mounted at the bottom of the sixth station 106 and can reversibly move up and down on the corresponding post in the sixth station 106, for example at pouch length changeovers. The non-limiting example shown in FIG. 3 generally illustrates the unitary gusset hole press 212/apex press 214 and its corresponding press pad at the bottom of the tooling station.

As noted above, an embodiment of the present disclosure mounts the tear notch tooling 222 in the sixth station 106 instead of the eighth station 108. Known HFFS machines position the tear notch tooling 222 offset relative to corresponding post such that the tear notch tooling 222 extends horizontally beyond the side of the post. To the contrary, the present disclosure provides an embodiment in which the post is shortened and the tear notch tooling 222 is vertically aligned with the post.

In the sixth station 106, an upper press pad can be mounted on the post opposite the tear notch tooling 222, and/or a lower press pad can be mounted on the same post, opposite the unitary gusset hole press 212/apex press 214. These press pads are preferably fixedly connected to the corresponding post such that they are not moved up or down.

As noted above, the side seal cooler bars 216 and the bottom seal cooler bars 218 in known HFFS machines are combined together and are positioned in the sixth station 106. In the present disclosure, the side seal cooler bars 216 are separated from the bottom seal cooler bars 218; the bottom seal cooler bars 218 can be mounted in the seventh station 107 instead of the sixth station 106, and the side seal cooler bars 216 can be mounted in the eighth station 108 instead of the sixth station 106. The zipper cooler 220 can also be positioned in the seventh station 107 (i.e., mounted on one or both of the thirteenth and fourteenth posts 183, 184).

The zipper cooler 220 is preferably fixedly positioned at the top of the seventh station 107 such that it cannot be moved up or down. Preferably the zipper cooler 220 can be positioned at the top of the seventh station 107, and the bottom seal cooler bars 218 can be positioned at the bottom of the seventh station 107.

As noted above, the side seal cooler bars 216 can be mounted in the eighth station 108 instead of the sixth station 106. Preferably, each of the side seal cooler bars 216 has length that is suitable for any size pouch and thus are fixedly connected to the corresponding post in the eighth station 108 such that they are not moved up or down. In an embodiment, one of the side seal cooler bars 216 comprises a rubber pad and the other one of the side seal cooler bars 216 comprises aluminum. Preferably, each of the bottom seal cooler bars 218 are reversibly adjustable up and down on the corresponding post in the seventh station 107, e.g., for a pouch length changeover.

In an embodiment, the machine 100 comprises a zipper sealer 161 on an additional post 160, preferably upstream from the first post 101. The machine 100 can comprise a zipper knife 163 extending down from the upper frame 152 to open standup pouches being made on the machine 100, and the zipper knife 163 can be manually or automatically adjustable in a slot in the upper frame 152 of the machine 100. The machine 100 can comprise hang hole tooling 162, preferably at the downstream end 151 of the machine 100 and/or downstream of the eighth post 108.

Preferably, each reversibly and selectively movable component is attached to its corresponding post by a fastener that moves between a first configuration in which a position of the movable component on the corresponding post is maintained and a second configuration in which the movable component is movable to adjust a vertical height of the movable component on the corresponding post (e.g., relative to the lower frame 153). A preferred non-limiting example of a suitable fastener is a bolt clamp in which the movable component is attached to the clamp, a bolt is turned one direction to press the bolt and/or an intermediate piece against the corresponding post, thereby restricting and/or preventing movement of the clamp and any component attached thereto, and the bolt is turned an opposite direction to withdraw the bolt and/or the intermediate piece from the post, thereby allowing vertical movement of the clamp and any component attached thereto. For example, the bolt clamp can be moved between the configurations by rotating the bolt using a handle of the fastener that is attached to the bolt or otherwise cooperates with the bolt.

Nevertheless, the fastener for each of the movable components may be any device capable of moving between a first configuration in which a position of the movable component on the corresponding post is maintained and a second configuration in which the movable component is movable to adjust a vertical height of the movable component on the corresponding post. The present disclosure is not limited to a specific embodiment of the fastener for each of the movable components.

The machine 100 preferably comprises a controller configured to control the timing of movement of one or more of (i) the mechanism moving the one or more films through the machine 100, (ii) the first, second, third and fourth side sealer bars 201-204, (iii) the first, second, third and fourth bottom sealer bars 301-304, (iv) the zipper melts 401-403, (v) the gusset hole press 212, (vi) the apex press 214, (vii) the side seal cooler bars 216, (viii) the bottom seal cooler bars 218, (ix) the zipper seal cooler 220, (x) the tear notch tooling 222, (xi) the zipper sealer 161, (xii) the hang hole tooling 162 and (xiii) the zipper knife 163. The controller preferably synchronizes operation of these components of the form-fill-seal machine 100.

Various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A horizontal form-fill-seal (HFFS) machine comprising:

a lower frame;

a plurality of sealer bars comprising a first side sealer bar, a second side sealer bar, a third side sealer bar, a fourth side sealer bar, a first bottom sealer bar and a second bottom sealer bar;

a first station comprising the first side sealer bar and the second side sealer bar;

a second station downstream from the first station and comprising the third side sealer bar and the fourth side sealer bar;

a third station downstream from the second station and comprising the first bottom sealer bar and the second bottom sealer bar, wherein each of the first, second and third stations comprises posts extending from the lower frame, and each of the posts has mounted thereon a corresponding sealer bar from the plurality of sealer bars;

a fastener that mounts the third side sealer bar on the corresponding post in the second station, and the fastener reversibly and selectively moves between a first configuration in which a position of the third side sealer bar on the corresponding post is maintained and a second configuration is which the third side sealer bar is movable to adjust a vertical height of the third side sealer bar relative to the lower frame;

a first fixedly attached zipper melt at the top of the third station;

a fourth station downstream from the third station, the fourth station comprising (i) third and fourth bottom sealer bars and (ii) a second fixedly attached zipper melt at the top of the fourth station; and a fifth station downstream from the fourth station, the fifth station comprising at least one component selected from the group consisting of (i) a vertically adjustable apex sealer and a corresponding press pad at the bottom of the fifth station and (ii) a third fixedly attached zipper melt at the top of the fifth station such that the third fixedly attached zipper melt is the next zipper melt downstream from the second fixedly attached zipper melt, which is the next zipper melt downstream from the first fixedly attached zipper melt.

2. The HFFS machine of claim 1, wherein the first side sealer bar and the second side sealer bar are fixedly positioned at the top of the first station.

3. The HFFS machine of claim 1 further comprising an additional fastener positioned in the second station, the additional fastener mounts the fourth side sealer bar on the corresponding post in the second station, and the additional fastener reversibly and selectively moves between a first configuration in which a position of the fourth side sealer bar on the corresponding post is maintained and a second configuration is which the fourth side sealer bar is movable to adjust a vertical height of the fourth side sealer bar relative to the lower frame.

4. The HFFS machine of claim 1 further comprising an additional fastener, the additional fastener is positioned in the third station, the additional fastener mounts the first bottom sealer bar on the corresponding post in the third station, and the additional fastener reversibly and selectively moves between a first configuration in which a position of the first bottom sealer bar on the corresponding post is maintained and a second configuration is which the first bottom sealer bar is movable to adjust a vertical height of the first bottom sealer bar relative to the lower frame.

5. The HFFS machine of claim 1 wherein the first and second side sealer bars are the only tooling in the first station, and the third and fourth side sealer bars are the only tooling in the second station.

6. The HFFS machine of claim 1 further comprising an additional fastener, the additional fastener is positioned in the fourth station, the additional fastener mounts the third bottom sealer bar on the corresponding post in the fourth station, and the additional fastener reversibly and selectively moves between a first configuration in which a position of the third bottom sealer bar on the corresponding post is maintained and a second configuration is which the third bottom sealer bar is movable to adjust a vertical height of the third bottom sealer bar relative to the lower frame.

7. The HFFS machine of claim 1, wherein the posts of the first and second stations are each taller than each of the posts of the third and fourth stations.

8. The HFFS machine of claim 1 further comprising a sixth station downstream from the fifth station, the sixth station comprising at least one component selected from the group consisting of (i) a vertically adjustable tear notch tooling and a corresponding press pad at the top of the sixth station and (ii) a vertically adjustable unitary device that is an apex and gusset hole press, and a corresponding press pad opposite from the unitary device, at the bottom of the fifth station.

9. The HFFS machine of claim 8 further comprising a seventh station downstream from the sixth station, the seventh station comprising at least one component selected from the group consisting of (i) a fixedly attached zipper cooler at the top of the seventh station and (ii) a bottom seal cooler bar at the bottom of the seventh station.

10. The HFFS machine of claim 9 further comprising an eighth station downstream from the seventh station, the eighth station comprising a side seal cooler bar.

11. A horizontal form-fill-seal (HFFS) machine comprising:

a lower frame;

a plurality of sealer bars comprising a first side sealer bar, a second side sealer bar, a third side sealer bar, a fourth side sealer bar, a first bottom sealer bar and a second bottom sealer bar;

a first station comprising the first side sealer bar and the second side sealer bar;

a second station downstream from the first station and comprising the third side sealer bar and the fourth side sealer bar;

a third station downstream from the second station and comprising the first bottom sealer bar and the second bottom sealer bar, wherein each of the first, second and third stations comprises posts extending from the lower frame, and each of the posts has mounted thereon a corresponding sealer bar from the plurality of sealer bars;

a first fixedly attached zipper melt at the top of the third station;

a fourth station downstream from the third station, the fourth station comprising (i) third and fourth bottom sealer bars and (ii) a second fixedly attached zipper melt at the top of the fourth station;

a fastener that mounts one of the bottom sealer bars on the corresponding post in the third and fourth stations, and the fastener reversibly and selectively moves between a first configuration in which a position of the bottom sealer bar on the corresponding post is maintained and a second configuration is which the bottom sealer bar is movable to adjust a vertical height of the bottom sealer bar relative to the lower frame; and a fifth station downstream from the fourth station, the fifth station comprising at least one component selected from the group consisting of (i) a vertically adjustable apex sealer and a corresponding press pad at the bottom of the fifth station and (ii) a third fixedly attached zipper melt at the top of the fifth station such that the third fixedly attached zipper melt is the next zipper melt downstream from the second fixedly attached zipper melt, which is the next zipper melt downstream from the first fixedly attached zipper melt.

* * * * *